United States Patent [19]

Yamamoto et al.

[11] Patent Number: 4,639,409

[45] Date of Patent: Jan. 27, 1987

[54] SILVER HALIDE COLOR PHOTOGRAPHIC LIGHT-SENSITIVE MATERIAL

[75] Inventors: Soichiro Yamamoto, Kanagawa; Takeo Shimada, Tokyo, both of Japan

[73] Assignee: Fuji Photo Film Co., Ltd., Kanagawa, Japan

[21] Appl. No.: 725,199

[22] Filed: Apr. 19, 1985

[30] Foreign Application Priority Data

Apr. 19, 1984 [JP] Japan ..... 59-79162

[51] Int. Cl.[4] ..... G03C 1/40; G03C 1/46; G03C 7/20

[52] U.S. Cl. ..... 430/505; 430/502; 430/506; 430/950

[58] Field of Search ..... 430/502, 505, 506, 542, 430/543, 559, 950

[56] References Cited

U.S. PATENT DOCUMENTS 2,322,037 6/1943 Lindquist ..... 430/950
2,338,664 1/1944 Nadeau et al. ..... 430/950
3,709,691 1/1973 Tani et al. ..... 430/950
4,366,236 12/1982 Takahashi ..... 430/502
4,460,681 7/1984 Frenchik ..... 430/502

*Primary Examiner*—Richard L. Schilling
*Attorney, Agent, or Firm*—Sughrue, Mion, Zinn, Macpeak and Seas

[57] ABSTRACT

A silver halide color photographic material comprising a support having thereon, in succession, a 1st silver halide photographic light-sensitive emulsion layer, a photographic auxiliary layer, and a 2nd silver halide photographic light-sensitive emulsion layer, or comprising a support having on one side thereof a 1st silver halide light-sensitive layer and on the other side thereof a photographic auxiliary layer and a 2nd silver halide photographic light-sensitive layer, the photographic auxiliary layer having a spectral reflectance of higher than 20% in a wavelength range of 410 nm to 700 nm and a spectral transmittance of higher than 5% in the same wavelength range. The invention provides a color photographic material giving recorded images, etc., capable of viewing by both reflected light and transmitted light.

4 Claims, 2 Drawing Figures

SILVER HALIDE COLOR PHOTOGRAPHIC LIGHT-SENSITIVE MATERIAL

FIELD OF THE INVENTION

This invention relates to a color photographic light-sensitive material using silver halide and, more particularly to a color photographic light-sensitive material giving recorded images, etc., capable of viewing by both reflected light and transmitted light.

BACKGROUND OF THE INVENTION

Recently, color photographic images are not only used as a simple recording materials but also color photographic images are widely used for display. This is due to the excellency of the image quality and the simplicity of making images as compared to images by ordinary multicolor printing and ink jet printing. As the display systems, there is a so-called reflected light system comprising viewing an image formed on a support by incident light from the image side and a so-called transmitted light system comprising viewing an image formed on a support by incident light from the back side of the image. It is known that under a specific conditions, such as a dark room, night outdoors, etc., the latter system provides a clearer image.

As a frequently practiced actual example of the latter system, there is a system of disposing a large number of fluorescent lamps behind a large-sized photographic positive transparent and fixing the positive transparent to a wall. Accordingly, in the case of displaying a photographic image, it is preferred to select a reflected light system or a transmitted light system according to the conditions under which the display will occur. If a good quality photographic image can be viewed by both reflected light and transmitted light, one photographic image can be used for both of the viewing systems and can be very advantageously utilized in, for example, a place where surrounding brightness changes large.

As a method of providing the above-described photographic image, a light-sensitive material comprising a support composed of a base containing a white pigment such as titanium oxide, etc., kneaded therein, and having thereon color photographic light-sensitive layers has been proposed. The object of this system is that the support functions as a light reflecting layer in the case of viewing the image by reflected light and also the support functions as a light transmitting layer in the case of viewing the image by transmitted light. However, in the case of viewing one image by a reflected light system and a transmitted light system, it is very difficult to provide a photographic material which gives a clear image having a preferred color density for both the systems. That is, in the case of viewing an image showing a proper density in a reflected light system by transmitted light, the density of the image is too low and the image is viewed indistinctly. On the other hand, in the case of viewing an image showing a proper density in a transmitted light system by reflected light, the color density is too high and the image is viewed as a dark image. Thus, such a conventional photographic image is unsuitable for display in both the reflected light system and the transmitted light system.

SUMMARY OF THE INVENTION

A 1st object of this invention is to provide a novel color photographic light-sensitive material capable of giving a color photographic image having an image density suitable for each of a reflected light system and a transmitted light system.

A 2nd object of this invention is to provide a novel color photographic light-sensitive material capable of giving a color photographic image which can be viewed clearly without being dimmed in both the reflected light system and the transmitted light system.

The inventors have found (1) that the reason why one photographic image is unsuitable for viewing by both a reflected light system and a transmitted light system is mainly due to the difference in the most suitable image density between the two systems and (2) that a light-sensitive material giving a photographic image having the most suitable image density in the case of viewing by reflected light and showing the most suitable image density in the case of viewing but transmitted light by supplementing the image density without reducing the clearness thereof in the case of viewing by transmitted light can be suitably used for both a reflected light system and a transmitted light system.

That is, the above-described objects of this invention can be achieved by the silver halide color photographic light-sensitive material of the present invention as set forth below.

According to this invention, there is provided a silver halide color photographic light-sensitive material comprising a support having thereon, in succession, a 1st silver halide photographic light-sensitive emulsion layer, a photographic auxiliary layer, and a 2nd silver halide photographic light-sensitive emulsion layer in this order, or a silver halide color photographic light-sensitive material comprising a support having on one side thereof a 1st silver halide photographic light-sensitive emulsion layer and on another side thereof a photographic auxiliary layer and a 2nd silver halide photographic light-sensitive emulsion layer in this order, wherein said photographic auxiliary layer has a spectral reflectance of not less than 20% in the range of 410 nm to 700 nm and a spectral transmittance of not less than 5% in the aforesaid wavelength range.

According to another embodiment of this invention, there is further provided a silver halide color photographic light-sensitive material as set forth above, wherein the photographic auxiliary layer comprises a hydrophilic colloid layer having dispersed therein at least one kind of white pigment.

DETAILED DESCRIPTION OF THE INVENTION

The invention is explained below in detail.

Figure 1:
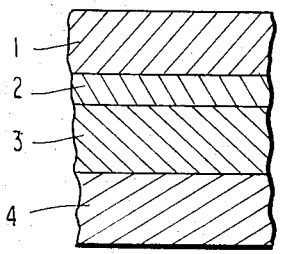
FIG. 1 is a schematic sectional view showing one embodiment of this invention and FIG. 2 is a schematic sectional view showing another embodiment of this invention.
Figure 2:
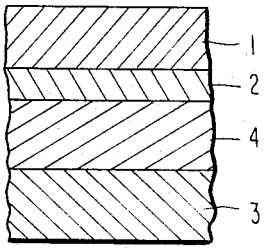

FIG. 1 and FIG. 2 are schematic sectional views showing two embodiments of this invention. The silver halide color photographic light-sensitive materials of this invention illustrated in FIG. 1 and FIG. 2 differ only in layer structure (the order of layers disposed) and each of the layer elements 1 to 4, constituting the photographic light-sensitive material, is same in both of the embodiments. That is, in the figures, a numeral 1 is a 2nd silver halide photographic light-sensitive emulsion layer, 2 a photographic auxiliary layer, 3 a 1st silver halide photographic light-sensitive emulsion layer, and 4 a support.

In the embodiment shown in FIG. 1, the photographic light-sensitive material is composed of a support 4 having thereon, from the support side, a 1st silver halide photographic light-sensitive emulsion layer 3, a photographic auxiliary layer 2, and a 2nd silver halide photographic light-sensitive emulsion layer 1 in this order. Also, in the embodiment shown in FIG. 2, the photographic light-sensitive material is composed of a support 4 having on one side thereof a 1st silver halide photographic light-sensitive emulsion layer and on the opposite side thereof a photographic auxiliary layer 2 and a 2nd silver halide photographic light-sensitive emulsion layer 1 in this order.

In this invention, the photographic auxiliary layer 2 functions as a light reflecting layer in the case of viewing by reflected light and further functions as a light transmitting layer in the case of viewing by transmitted light, whereby a proper and clear color photographic image can be viewed in both the reflected light system and the transmitted light system.

The silver halide photographic light-sensitive emulsion layer 1 in this invention is composed of at least one kind of light-sensitive emulsion layer selected from a blue-sensitive emulsion layer, a green-sensitive emulsion layer and a red-sensitive emulsion layer.

The photographic auxiliary layer 2 in this invention is preferably composed of a hydrophilic colloid having dispersed therein at least one kind of white pigment, and the photographic auxiliary layer also has a spectral reflectance of not less than 20% in the wavelength range of 410 nm to 700 nm and a spectral transmittance of not less than 5% in the above-described wavelength range. In this case, when a base having kneaded therein titanium oxide, etc., as described hereinbefore is used as the photographic auxiliary layer, there are disadvantages in that the production cost is increased and the image is dimmed in the case of viewing by transmitted light.

The silver halide photographic light-sensitive emulsion layer 3 is composed of the following (3-i) or (3-ii)

(3-i) At least one light-sensitive emulsion layer selected from a blue-sensitive emulsion layer, a green-sensitive emulsion layer, and a red-sensitive emulsion layer.

(3-ii) A light-sensitive emulsion layer containing a black and white silver halide emulsion and at least one kind of dye image-forming compound.

It is preferred that the support 4 is substantially transparent but the support may be colored to an extent of not disturbing the observation of color images.

Now, the elements for constituting the photographic light-sensitive material of this invention will be explained in detail.

Both the silver halide photographic light-sensitive emulsion layers 1 and (3-i) are composed of at least one light-sensitive silver halide emulsion layer selected from a blue-sensitive emulsion layer, a green-sensitive emulsion layer and a red-sensitive emulsion layer as described above and the case that the light-sensitive emulsion layer is composed of the aforesaid three kinds of silver halide emulsion layers is most preferred. When the photographic process for forming color images of the photographic light-sensitive material of this invention is a color development process, a yellow dye-forming coupler is usually used for the blue-sensitive emulsion layer, a magenta dye-forming coupler for the green-sensitive emulsion layer, and a cyan dye-forming coupler for the red-sensitive emulsion layer but other combinations than above may be employed and further a mixture of two or more kinds of dye-forming couplers may be used.

Also, when the photographic process is a silver dye bleach process, a yellow dye is usually used for the blue-sensitive emulsion layer, a magenta dye for the green-sensitive emulsion layer and a cyan dye for the red-sensitive emulsion layer but other combinations may be employed and further a mixture of two or more kinds of dyes may be used.

In the cases of employing the color development process and the silver dye bleach process, the silver halide emulsions for use in this invention may be of a negative working type or of a direct reversal type. Also, the silver halide photographic light-sensitive emulsion layers 1 and (3-i) may be, if necessary, composed of two or more light-sensitive emulsion layers. There is no particular restriction on the disposing order of the emulsion layers in the case of constituting the silver halide emulsion layer 1 and (3-i) by two or more silver halide emulsion layers, and if necessary, non light-sensitive auxiliary layers (e. g., a protective layer, a filter layer, an interlayer, a subbing layer, etc.,) may be formed in the silver halide photographic light-sensitive layer 1 or (3-i).

In this case, the silver halide photographic light-sensitive emulsion layer 1 may contain therein a dye-forming coupler and the silver halide photographic light-sensitive emulsion layer 3 may contain therein a silver dye bleaching dye or the silver halide photographic light-sensitive emulsion layer 1 may contain therein a silver dye bleaching dye and the silver halide photographic light-sensitive emulsion layer 3 may contain therein a dye-forming coupler. Also, the dye-forming coupler and the dye may be incorporated in the same silver halide emulsion layer or separate silver halide emulsion layers in the 2nd silver halide photographic light-sensitive emulsion layer 1 and/or 3.

A black and white silver halide emulsion is inevitably used for the silver halide photographic light-sensitive emulsion layer (3-ii) and in the case of color development processes, the light-sensitive layer contains a black dye-forming coupler or simultaneously contains three couplers of a yellow dye-forming coupler, a magenta dye-forming coupler and a cyan dye-forming coupler at a ratio necessary for giving a black image at development. Also, in the case of a silver dye bleach process, the light-sensitive layer simultaneously contains three dyes of a yellow dye, a magenta dye and a cyan dye at a ratio necessary for giving black dye at dye bleach step.

The silver halide emulsion for use in the silver halide photographic light-sensitive emulsion layer (3-ii) may be of a negative working type or a direct reversal type. Also, the silver halide photographic light-sensitive emulsion layer (3-ii) may be, if necessary, two or more. Also, if necessary, a non light-sensitive auxiliary layer (a filter layer, an interlayer, a subbing layer, etc.,) may be formed between the light-sensitive layers, or may be formed between the light-sensitive layer and an adjacent photographic auxiliary layer 2 or the support 4.

The photographic auxiliary layer 2 is composed of a hydrophilic colloid having dispersed therein at least one kind of white pigment and has a spectral reflectance of not less than 20%, preferably not less than 50% in the wavelength range of 410 nm to 700 nm and has a spectral transmittance of not less than 5%, preferably not less than 25% in the same wavelength range.

As the white pigment for use in the photographic auxiliary layer 2, there are for example, titanium oxide, zinc oxide, silica, calcium sulfate, barium sulfate, calcium carbonate, zinc sulfide, aluminum silicate, satin white ($3CaO.Al_2O_3.3CaSO_4.3H_2O$), lithopone (a mixture of 28% ZnS and 72% $BaSO_4$), clay, talc, diatomaceous earth, etc. They may be used solely or as a mixture of two or more these pigments.

The content of the white pigment in the photographic auxiliary layer 2 is not less than 10% by weight, preferably not less than 40% by weight. Also, the particle size of the white pigment for use in this invention is 0.1 to 1.0μ, preferably 0.2 to 0.5μ as a mean particle size.

The thickness of the photographic auxiliary layer 2 is 0.5 to 5μ, preferably 1 to 3μ.

The measurement of the spectral reflectance and the spectral transmittance in this invention is performed by ordinary methods using Hitachi Color Analyzer Type 307 (trade name, made by Hitachi, Ltd.).

The effect of this invention is obtained when the photographic auxiliary layer 2 has a spectral reflectance of not less than 20%, preferably not less than 50% in the wavelength range of 410 nm to 700 nm. If the spectral reflectance is lower than 20%, the white portion of the image formed does not show sufficient whiteness and the colored portions of the image do not show clear color tone in the case of viewing by reflected light.

Also, the effect of this invention is obtained when the photographic auxiliary layer has a spectral transmittance of not less than 5%, preferably not less than 25% in the wavelength range of 410 nm to 700 nm. If the spectral transmittance is lower than 5%, the amount of light entering the light-sensitive layer of a distant side from the light-source (i.e., the light-sensitive layer exposed through the aforesaid photographic auxiliary layer) is insufficient at light exposure, sufficient coloring density is not obtained. Also, the image viewed by transmitted light generally becomes dark and is not clear.

Accordingly, when the photographic auxiliary layer has a spectral reflectance of not less than 20%, preferably not less than 50% in the range of 410 nm to 700 nm and has a spectral transmittance of not less than 5%, preferably not less than 25% in the aforesaid wavelength range, the effect of this invention can be sufficiently obtained.

As the support 4 for use in this invention, transparent supports usually used as the supports for photographic light-sensitive materials, such as cellulose acetate films, polyethylene terephthalate films, polycarbonate films, laminates of these films, thin glass sheets, etc., may be used. These transparent supports may be, if necessary, colored by the addition of a dye or pigment to an extent of not disturbing the observation of images.

The silver halide color photographic light-sensitive material of this invention can be used mainly for display. When the surroundings are bright, the color images formed can be viewed by reflected light in, for example, a bright room or outdoor in the daytime, etc and when the surroundings are dark, the images can be viewed by transmitted light by illuminating the image from the back side in, for example, a dark room and outdoor in the night. Therefore, the photographic light-sensitive material of this invention provides proper and clear images which can be viewed by any image-viewing system regardless of the place of the image disposed.

The silver halide color photographic light-sensitive material of this invention can be suitably used not only for obtaining so-called natural color images but also for obtaining monochromatic or multicolor images of characters, designs, etc. Furthermore, by adding specific dye or pigment to the aforesaid photographic auxiliary layer in addition to the white pigment or by properly adding the silver halide photographic light-sensitive emulsion layer exposing in a wavelength range and the dye-forming couplers containing the dye not having the complementary color connection with the wavelength range (in the case of a color development process), or the dyes having the color not having the complementary color connection with the wavelength range (in the case of a silver dye bleach process), a different color scheme can be obtained between the case of viewing the image by reflected light and the case of viewing the image transmitted light. [Generally, there is a complementary color connection between the silver halide photographic light-sensitive emulsion layer and the color of the dye formed by the dye-forming coupler in the light-sensitive emulsion layer (in the case of a color development process) or the color of the dye in the light-sensitive emulsion layer (in the case of a silver dye bleach process)].

Thus, the invention also has the specific feature of applicability to various manners in display, etc.

In the case of using dye-forming couplers in this invention, it is preferred that the coupler has a non-diffusible group, in the molecule and the coupler may be of four equivalent or two equivalent.

A magenta coupler for use in this invention includes pyrazolone compounds, indazolone compounds, cyanoacetyl compounds, pyrazoloazole compounds, etc. A yellow coupler includes known open chain ketomethylene compounds, in particular, benzoylacetanilide compounds and pivaloylacetanilide compounds. A cyan coupler includes phenol derivatives and naphthol derivatives.

In the case of using a silver dye bleach process in this invention, azo dyes, anthraquinone dyes, indigoid dyes, etc., can be used as the dyes and magenta, yellow and cyan dyes which can be reductively bleached using silver as catalyst can be used. Particularly preferred dyes include monoazo dyes, bis-azo dyes, tris-azo dyes, or dyes having 4 or more azo groups.

As the silver dye bleaching dye for use in this invention, not only dyes having the desired color from the first but also so-called shift type dyes which are shifted to a desired color after processing may be used.

In this invention, couplers can be incorporated in the silver halide emulsion layers by a known method, such as the method described in, for example U.S. Pat. No. 2,322,027. For example, the coupler is dissolved in an organic solvent having a high boiling point such as a phthalic acid alkyl ester, a phosphoric acid ester, a citric acid ester, a benzoic acid ester, an alkylamide, fatty acid esters, trimesic acid esters, etc., or an organic solvent having a boiling point of about 30° C. to 150° C., such as a lower alkyl acetate such as ethyl acetate, butyl acetate, etc., ethyl propionate, secondary butyl alcohol, methyl isobutyl ketone, β-ethoxyethyl acetate, methyl cellosolve acetate, etc., and then dispersed in a hydrophilic colloid as the solution. The aforesaid organic solvent having a high boiling point and organic solvent having a low boiling point may be used as a mixture.

Also, a dispersion method by a polymer described in Japanese Patent Publication No. 39853/76 and Japanese Patent Application (OPI) No. 59943/76 (the term "OPI" indicates an unexamined published patent application open to public inspection) can be used.

When the coupler has an acid group such as carboxylic acid, sulfonic acid, etc, the coupler can be introduced into a hydrophilic colloid as an alkaline aqueous solution thereof.

When the coupler is a so-called polymer coupler, the emulsified polymerication product of the coupler may be added to a silver halide emulsion as it is or after solution polymerization of coupler, the coupler polymer may be collected therefrom, dissolved in an organic solvent and dispersed in the silver halide emulsion.

When the silver dye bleaching dye is introduced into the silver halide emulsion layer, the coupler, as well as a water soluble coupler, can be introduced into a hydrophilic colloid as an alkaline aqueous solution thereof.

As the binder or protective colloid which can be used for the silver halide emulsion layers and interlayers of the photographic light-sensitive material of this invention, gelatin is advantageously used but other hydrophilic colloids can be used solely or together with gelatin.

As the silver halide for the silver halide photographic emulsion layers of the photographic light-sensitive material of this invention, silver bromide, silver iodobromide, silver iodochlorobromide, silver chlorobromide, or silver chloride can be used.

There is no particular restriction on the mean grain size (in the case of spherical grains or grains similar to spherical grains, the diameter of the grains is employed as the grain size and in the case of cubic grains, the long side length is employed as the grain size and is expressed by the mean value based on the projected area) of the silver halide grains in the silver halide photographic emulsion but the mean grain size is preferably not more than $3\mu$.

The grain size distribution may be narrow or broad. The silver halide grains in the silver halide photographic emulsion for use in this invention may have a regular crystal form such as a cubic form, an octahedral form, etc., or an irregular crystal form such as a spherical form, a tabular form, etc., or may be a composite form of these crystal forms. Furthermore, the silver halide grains may be a mixture of these silver halide grains of various crystal forms.

Also, a silver halide emulsion wherein tabular silver halide grains having the diameter of the grains more than 5 times larger than the thickness thereof occupy not less than 50% of the total projection area may be used in this invention.

The silver halide grains for use in this invention may differ in phase between the inside thereof and the surface portion thereof. Also, the silver halide grains may be the grains mainly forming a latent image at the surface thereof or grains mainly forming a latent image in the inside thereof.

The silver halide photographic emulsions for use in this invention can be prepared using the methods described in P. Glafkides, *Chimie et Physique Photographique,* (published by Paul Montel Co., 1967), G. F. Duffin, *Photographic Emulsion Chemistry* (published by The Focal Press, 1966), V. L. Zelikman et al, *Making and Coating Photographic Emulsion* (published by The Focal Press, 1964), etc.

Two kinds or more silver halide emulsions separately prepared may be used as a mixture.

The silver halide grains may be formed or physically ripened in the presence of a cadmium salt, a zinc salt, a lead salt, a thalium salt, an iridium salt or a complex salt thereof, a rhodium salt or a complex salt thereof, an iron salt or a complex salt thereof, etc.

After the formation of the silver halide emulsion by precipitation or after physical ripening of the silver halide emulsion, soluble salts are usually removed therefrom and for removing the salts, a so-called noodle washing method of performing washing by gelling gelatin in the emulsion or a flocculation method may be used.

The silver halide emulsions for use in this invention are usually chemically sensitized. For the chemical sensitization, the method described in, for example, H. Frieser edited, *Die Grundlagen der Photographischen Prozesse mit Silberhalogeniden,* pages 675–734 (published by Akademische Verlagsgesellschaft, 1968) can be used.

The silver halide photographic emulsions for use in this invention can contain various compounds for preventing the formation of fog during the production, storage and photographic processing of the photographic light-sensitive material or for stabilizing the photographic performance of the photographic light-sensitive material. That is, they are various compounds known as antifoggants or stabilizers, such as azoles, mercaptopyrimidines, triazines, azaindenes, pentaazaindenes, benzenethiosulfonic acid, benzene-sulfinic acid, benzene-sulfonic acid amide, etc. The silver halide photographic emulsion layers and/or other hydrophilic colloid layer or layers of the silver halide color photographic light-sensitive materials of this invention can contain various surface active agents for the purposes of coating aids, antistatic, improvement of sliding property, accelerating of emulsification and dispersion, prevention of adhesion, improvement of photographic characteristics (e. g., development acceleration, increasing high contrast, sensitization, etc.,), etc.

The silver halide photographic emulsion layers of the photographic light-sensitive materials of this invention may further contain a polyalkylene oxide or derivatives thereof, such as the ethers, esters, amines, etc., thioether compounds, thiomorpholines, quaternary ammonium salt compounds, urethane derivatives, urea derivatives, imidazole derivatives, 3-pyrazolidones, etc., for increasing the sensitivity, increasing the contrast, or accelerating development.

Furthermore, the photographic light-sensitive materials of this invention may contain in the silver halide photographic emulsion layers or other hydrophilic colloid layer or layers a dispersion of a water-insoluble or sparingly water-soluble synthetic polymer for improving the dimensional stability.

The silver halide photographic emulsions for use in this invention may be spectrally sensitized by methine dyes and the like. As the dyes used for this purpose, there are cyanine dyes, merocyanine dyes, complex cyanine dyes, complex merocyanine dyes, holopolar cyanine dyes, hemicyanine dyes, styryl dyes, and hemioxonole dyes.

These sensitizing dyes may be used solely or as a combination, and the combination of sensitizing dyes is frequently used for the purpose of super sensitization.

The photographic emulsion layers may further contain dyes showing no spectral sensitizing action by themselves or materials having substantially no absorption of visible light and showing super sensitization together with the sensitizing dyes.

The photographic light-sensitive materials of this invention may further contain in the silver halide photographic emulsion layers or other hydrophilic colloid layers an inorganic or organic hardening agent.

The photographic light-sensitive materials of this invention may further contain in the hydrophilic colloid layers ultraviolet absorbents.

When the photographic light-sensitive materials of this invention contain in the hydrophilic colloid layers dyes and ultraviolet absorbents, they may be mordanted by a cationic polymer, etc.

The photographic light-sensitive materials of this invention may further contain hydroquinone derivatives, aminophenol derivatives, gallic acid derivatives, ascorbic acid derivatives, etc., as a color antifoggant.

When the photographic material of this invention contains a ultraviolet absorbent in the hydrophilic colloid layer, a ultraviolet absorptive coupler (e. g., α-naphtholic cyan dye-forming coupler) or a ultraviolet absorptive polymer may be used. These ultraviolet absorbents may be mordanted to specific layers of the photographic light-sensitive materials of this invention.

The photographic light-sensitive materials of this invention may contain in the hydrophilic colloid layers water-soluble dyes as filter dyes or for irradiation prevention, etc.

At the practice of this invention, the photographic light-sensitive materials of this invention may be used together with known fading preventing agents and the color image stabilizers of this invention may be used solely or as a combination. The known fading preventing agents include hydroquinone derivatives, gallic acid derivatives, p-alkoxyphenols, p-oxyphenol derivatives, and bisphenols.

As the processing process for the silver halide color photographic light-sensitive materials of this invention, there are two kinds of processes. That is, when dye-forming couplers are used for the foregoing silver halide photographic materials of this invention, the photographic processing is performed in the order of color development, bleach and fix (or blix) and when silver dye bleaching dyes are used for the photographic materials of this invention, the photographic processing is performed in the order of black and white development, silver dye bleach, silver bleach and fix (or blix). Also, the photographic processing of the case of using both the dye-forming couplers and the silver dye bleaching dyes is performed in the order of color development, silver dye bleach, silver bleach and fix (or blix).

The color developer is generally composed of an alkaline aqueous solution containing a color developing agent (e. g., phenylenediamines). The color developer may further contain various additives such as a pH buffer, a development restrainer, an antifoggant, a preservative, a development accelerator, a fogging agent, an antioxidizing agent, an auxiliary developing agent, etc.

The silver bleaching process may be performed simultaneously with the fix process or may be performed separately from the fix process. As the bleaching agent, there are multivalent metal compounds, peroxides, quinones, nitroso compounds, etc.

The fix solution may be a solution having an ordinary composition generally employed for the purpose in the photographic field. As the fixing agent, thiosulfates, thiocyanates as well as organic sulfur compounds having a fixing action can be used.

As the black and white developer, a conventional black and white developer such as a PQ developer, etc., can be used.

For the silver dye bleaching step, an acidifying agent (e. g., a mineral acid or an organic acid), a compound forming a silver salt or a silver complex (e. g., pottasium bromide, thiosemicarbazide, etc.,), and a dye bleach accelerating catalyst (e. g., pyrazine, phthalazine, phenazine, etc.,), etc., are used for reductively bleaching dyes using developed silver as a catalyst.

Below, the invention is further explained practically by the following example but the invention is not limited to the example.

EXAMPLE

Sample (A) was prepared by coating, in succession, the following layers on a transparent polyester film of 170 μm in thickness.

A 1st layer: An ultraviolet absorbing layer containing 1,000 mg/m$^2$ of a ultraviolet absorbent, 2-(2-hydroxy-3-sec-butyl-5-tert-butylphenyl)benzotriazole, 250 mg/m$^2$ of a solvent of the ultraviolet absorbent, dibutyl phthalate, and 1,200 mg/m$^2$ of gelatin.

A 2nd layer: A red-sensitive emulsion layer containing a silver chlorobromide emulsion (50 mol % Br, silver coverage of 300 mg/m$^2$), 400 mg/m$^2$ of a cyan coupler, 2-[α-(2,4-di-tert-pentylphenoxy)butanamido]-4,6-dichloro-5-methylphenol, 200 mg/m$^2$ of a coupler solvent, dibutyl phthalate, and 1,000 mg/m$^2$ of gelatin.

A 3rd layer: An interlayer composed of 1,000 mg/m$^2$ of gelatin.

A 4th layer: A green-sensitive emulsion layer containing a silver chlorobromide emulsion (50 mol % Br, a silver coverage of 200 mg/m$^2$), 300 mg/m$^2$ of a magenta coupler, 1-(2,4,6-trichlorophenyl)-3-(2-chloro-5-tetradecanamido)anilino-4-[(2-n-butoxy-5-tert-octyl)phenyl-thio]-2-pyrazolin-5-one, 600 mg/m$^2$ of a coupler solvent, tricresyl phosphate, and 1,000 mg/m$^2$ of gelatin.

A 5th layer: An interlayer the same as the 3rd layer.

A 6th layer: A blue-sensitive layer containing a silver chlorobromide emulsion (80 mol % Br, a silver coverage of 400 mg/m$^2$), 300 mg/m$^2$ of a yellow coupler, α-pivaloyl-α-(2,4-dioxo-5,5-dimethyloxazolizin-3-yl)-2-chloro-5-[α-(2,4-di-tert-pentylphenoxy)-butanamido]acetanilide, 150 mg/m$^2$ of a coupler solvent, dioctylbutyl phosphate, and 1,200 mg/m$^2$ of gelatin.

A 7th layer: An interlayer composed of 2.6 g/m$^2$ of gelatin.

A 8th layer: A photographic auxiliary layer* containing 1.0 g/m$^2$ of gelatin and 4.5 g/m$^2$ of titanium oxide.

*: The spectral reflectance in the range of 410 nm to 700 nm was 80% and the spectral transmittance in the same wavelength range was 30%.

A 9th layer: An interlayer the same as the 7th layer.

A 10th layer: A blue-sensitive emulsion layer the same as the 6th layer.

A 11th layer: An interlayer the same as the 3rd layer.

A 12th layer: A green-sensitive emulsion layer the same as the 4th layer.

A 13th layer: An interlayer the same as the 3rd layer.

A 14th layer: A red-sensitive emulsion layer the same as the 2nd layer.

A 15th layer: A ultraviolet absorbing layer the same as the 1st layer.

A 16th layer: A protective layer composed of 1,000 mg/m$^2$ of gelatin.

Then, Sample (B) was prepared by coating, in succession, the layers of the same layer structure as the 10th to 16th layers in Sample (A), each having the same composition as each of the 10th to 16th layers on a support formed by coating polyethylene containing 7.5% by weight anatase-type titanium oxide on a base paper having a basis weight of 180 g/m$^2$ (resin-coated paper) at a thickness of 40 μm.

Furthermore, Sample (C) was prepared by forming the layers having the same layer structure as Sample (B) on a polyester film containing 5.0% by weight rutile-type titanium oxide (translucent film).

Also, Sample (D) was prepared by forming the layers having the same layer structure as the 8th to 16th layers in Sample (A), each having the same composition as each of the 8th to 16th layers on a transparent film the same as used for Sample (A).

Moreover, Sample (E) was prepared by following the same procedure as the preparation of Sample (D) except that each coating amount of the constituting elements for the red-sensitive emulsion layer, the green-sensitive emulsion layer and the blue-sensitive emulsion layer was increased to twice that of each constitutional element in Sample (D).

Then, each of the samples thus prepared was stepwise exposed by blue light, green light, and red light and then processed as follows:

| Processing step | Temperature | Time |
|---|---|---|
| Development | 33° C. | 3 min. 30 sec. |
| Blix | 33° C. | 1 min. 30 sec. |
| Washing | 28–35° C. | 3 min. |

The compositions of the processing liquids used in the above processing steps were as follows.

Developer:

-continued

| | | |
|---|---|---|
| Benzyl Alcohol | 15 | ml |
| Diethylenetriamine Pentaacetic Acid | 5 | g |
| KBr | 0.4 | g |
| $Na_2SO_3$ | 5 | g |
| $Na_2CO_3$ | 30 | g |
| Hydroxylamine Sulfate | 2 | g |
| 4-Amino-3-methyl-N—ethyl-N—β-(methanesulfonamido) ethylaniline, $3/2H_2SO_4,H_2O$ | 4.5 | g |
| Water to make | 1 | liter |
| pH | 10.1 | |
| Blix Solution: | | |
| Ammonium Thiosulfate (70 wt %) | 150 | ml |
| $Na_2SO_3$ | 5 | g |
| Ethylenediamine Tetraacetic Acid (EDTA) iron (III) sodium salt | 40 | g |
| EDTA | 4 | g |
| Water to make | 1 | liter |
| pH | 6.8 | |

For each of the aforesaid samples, the reflection density and transmission density were measured. The results are shown in Table.

In both the reflected light system and the transmitted light system, a sample showing the proper maximum density and showing a large difference between the maximum density and the minimum density is better. As shown in the results of Table 1, Sample (B) and Sample (D) show good results in the case of reflected light system but are deficient in density in the case of the transmitted light system. Sample (E) shows good results in the case of the transmitted light system but shows too high a density in the case of the reflected light system. Sample (C) is deficient in density in both systems.

On the other hand, Sample (A) of this invention shows good results in both the reflected light system and the transmitted light system.

TABLE

| | | Sample | | | | |
|---|---|---|---|---|---|---|
| | | (A) | (B) | (C) | (D) | (E) |
| Evaluation Item*1 | | | | | | |
| Reflection Maximum | | | | | | |
| Density $D^{Ref}_{max}$ | B | 2.50 | 2.40 | 2.58 | 2.50 | 2.70 |
| | G | 2.90 | 2.60 | 2.90 | 2.80 | 3.02 |
| | R | 2.90 | 2.78 | 2.96 | 2.90 | 3.00 |
| Reflection Minimum | | | | | | |
| Density $D^{Ref}_{min}$ | B | 0.28 | 0.08 | 0.46 | 0.16 | 0.16 |
| | G | 0.32 | 0.12 | 0.53 | 0.19 | 0.19 |
| | R | 0.34 | 0.12 | 0.54 | 0.22 | 0.22 |
| Transmission Maximum | | | | | | |
| Density $D^{Trans}_{max}$ | B | 3.05 | 2.48 | 1.97 | 2.40 | 3.08 |
| | G | 3.10 | 2.26 | 1.77 | 2.08 | 3.14 |
| | R | 3.24 | 2.56 | 1.95 | 2.04 | 3.20 |
| Transmission Minimum | | | | | | |
| Density $D^{Trans}_{min}$ | B | 0.52 | 0.90 | 0.43 | 0.68 | 0.70 |
| | G | 0.39 | 0.92 | 0.33 | 0.56 | 0.57 |
| | R | 0.36 | 0.91 | 0.31 | 0.51 | 0.52 |
| $D^{Ref}_{max} - D^{Ref}_{min}$ | B | 2.22 | 2.32 | 2.12 | 2.34 | 2.54 |
| | G | 2.58 | 2.48 | 2.37 | 2.61 | 2.83 |
| | R | 2.56 | 2.66 | 2.42 | 2.68 | 2.78 |
| $D^{Trans}_{max} - D^{Trans}_{min}$ | B | 2.53 | 1.58 | 1.54 | 1.72 | 2.38 |
| | G | 2.71 | 1.34 | 1.44 | 1.52 | 2.57 |
| | R | 2.88 | 1.65 | 1.64 | 1.53 | 2.68 |
| Practical Evaluation*2 Reflection System | | O | O | Δ ↓ | O | Δ ↑ |
| Transmission System | | O | X ↓ | X ↓ | X ↓ | O |
| | | Inven- | Compar- | Compar- | Compar- | Compar- |

TABLE-continued

| | Sample | | | | |
|---|---|---|---|---|---|
| | (A) | (B) | (C) | (D) | (E) |
| | tion | ison | ison | ison | ison |

*[1]B, G and R show blue-sensitive emulsion layer, green-sensitive emulsion layer, and red-sensitive emulsion layer, respectively.
*[2]O, X represents "suitable" and "unsuitable", respectively and Δ represents "intermediate". Also, ↓ and ↑ represent "density deficiency" and "density excessive", respectively.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon, in succession, a 1st silver halide photographic light-sensitive emulsion layer, a photographic auxiliary layer, and a 2nd silver halide photographic light sensitive emulsion layer, or a support having on one side thereof a 1st silver halide photographic light-sensitive emulsion layer and on the other side thereof, in succession, a photographic auxiliary layer and a 2nd silver halide photographic light-sensitive emulsion layer, said photographic auxiliary layer comprising a hydrophilic colloid having dispersed therein at least one kind of white pigment having a mean particle size of 0.1 to 1.0μ in an amount of at least 10% by weight, having a thickness of 0.5 to 5μ, having a spectral reflectance of not less than 20% in a wavelength range of 410 nm to 700 nm and having a spectral transmittance of not less than 5% in said wavelength range.

2. The silver halide color photographic light-sensitive material as claimed in claim 1, wherein the 1st silver halide photographic light-sensitive emulsion layer and the 2nd silver halide photographic light-sensitive emulsion layer each comprises a blue-sensitive emulsion layer, a green-sensitive emulsion layer, and a red-sensitive emulsion layer.

3. The silver halide color photographic light-sensitive material as claimed in claim 2, wherein the color photographic light-sensitive material is for a color development process and said blue-sensitive emulsion layer, green-sensitive emulsion layer and red-sensitive emulsion layer contain a yellow dye-forming coupler, a magenta dye-forming coupler and a cyan dye-forming coupler, respectively.

4. The silver halide color photographic light-sensitive material as claimed in claim 2, wherein the color photographic light-sensitive material is for a silver dye bleach process and said blue-sensitive emulsion layer, green-sensitive emulsion layer and red-sensitive emulsion layer contain a yellow dye, a magenta dye and a cyan dye, respectively.

* * * * *